US005133272A

United States Patent [19]

Hayashi

[11] Patent Number: 5,133,272

[45] Date of Patent: Jul. 28, 1992

[54] SEWING MACHINE HAVING NEEDLE BAR DISCONNECTING MECHANISM AND THREAD CUTTING MECHANISM

[75] Inventor: Kazutoshi Hayashi, Nagoya, Japan

[73] Assignee: Brother Kogyo Kabushiki Kaisha, Japan

[21] Appl. No.: 675,963

[22] Filed: Mar. 27, 1991

[30] Foreign Application Priority Data

Mar. 28, 1990 [JP] Japan ..... 2-79188

[51] Int. Cl.[5] ..... D05B 69/00; D05B 65/00; D05B 3/02

[52] U.S. Cl. ..... 112/221; 112/291; 112/300; 112/453

[58] Field of Search ..... 112/291, 292, 300, 221, 112/275, 453, 308, 121.11, 306, 293, 296, 294, 295, 297, 298

[56] References Cited

U.S. PATENT DOCUMENTS

| | | | |
|---|---|---|---|
| 3,889,615 | 6/1975 | Uozake et al. | 112/300 X |
| 4,173,193 | 11/1979 | Morinaga et al. | 112/300 X |
| 4,325,313 | 4/1982 | Kawai et al. | 112/221 X |
| 4,592,297 | 6/1986 | Asano et al. | 112/291 X |
| 4,744,319 | 5/1988 | Rohr | 112/308 X |
| 4,995,328 | 2/1991 | Tanaka | 112/453 |

FOREIGN PATENT DOCUMENTS 62-139472 9/1987 Japan .

*Primary Examiner*—Peter Nerbun
*Attorney, Agent, or Firm*—Oliff & Berridge

[57] ABSTRACT

A sewing machine incorporates a needle bar disconnecting mechanism (3) and a thread cutting mechanism (9). The needle bar disconnecting mechanism (3) is interposed between an arm spindle (2) and a needle bar (4), which normally transmits rotations of the arm spindle (2) to the needle bar (4) to vertically move the latter up and down but disconnects the needle bar (4) from the arm spindle (2) to stop the vertical movement of the needle bar (4) when actuated. The thread cutting mechanism (9) cuts threads at the termination of stitching. A rotational phase detecting mechanism (11) is provided for detecting a rotational phase of the arm spindle (2). An electronic control circuit (12) actuates the needle bar disconnecting mechanism (3) when the rotational phase detecting mechanism (11) detects that the arm spindle (2) has reached a predetermined rotational phase after the thread cutting mechanism (9) is actuated. Therefore, after the threads are cut, a needle (5) attached to the needle bar (4) does not stick into a workpiece fabric.

14 Claims, 2 Drawing Sheets

SEWING MACHINE HAVING NEEDLE BAR DISCONNECTING MECHANISM AND THREAD CUTTING MECHANISM

BACKGROUND OF THE INVENTION

The present invention relates to sewing machines, and more particularly to a sewing machine provided with a needle bar disconnecting mechanism and a thread cutting mechanism. The former mechanism is provided for halting the vertical reciprocal movements of a needle bar to which a sewing needle is attached, and the latter mechanism is provided for cutting a needle thread and a bobbin thread.

Sewing machines having a lateral feeding mechanism in addition to a forward feeding mechanism to stitch embroidery or large decorative patterns have been known, as disclosed in copending U.S. patent application Ser. No. 07/525,765 now U.S. Pat. No. 4,995,328 assigned to the same assignee. A workpiece fabric on a throat plate of the sewing machine is moved in the forward direction by the forward feeding mechanism and moved in a lateral direction orthogonal to the forward direction by the lateral feeding mechanism. It is thus necessary that the vertical reciprocal movements of the needle bar be temporarily stopped during the lateral movements of the workpiece fabric. To this end, a needle bar disconnecting mechanism has conventionally been employed which is interposed between an arm spindle and a needle bar for disconnecting the latter from the former.

One example of such needle bar disconnecting mechanisms is disclosed in Japanese Laid-Open Utility Model Publication No. 62-139472. According to the mechanism disclosed therein, a clutch is provided for isolating the needle bar from a needle bar gripper by swinging the needle bar with a stepping motor a width longer than a zigzag stitching width.

On the other hand, sewing machines of the type having a thread cutting mechanism driven by a sewing motor have been known, as disclosed in U.S. Pat. No. 4,592,297. The thread cutting mechanism is disposed beneath a throat plate for automatically cutting threads at the termination of stitching. In such a type of sewing machine, it is necessary that the reciprocal movements of the needle bar be stopped after actuation of the thread cutting mechanism to prevent a sewing needle from sticking in a workpiece fabric due to inertia of the sewing motor after the threads have been cut. To this end, conventional sewing machines are provided with a clutch between the sewing motor and an arm spindle for disconnecting the needle bar from the sewing motor after the thread cutting mechanism is actuated.

However, the provision of the clutch used in conjunction with the thread cutting increases the number of components or parts of the sewing machine despite the fact that the clutch is used only when the threads are cut.

SUMMARY OF THE INVENTION

Accordingly, it is an object of the present invention to provide a sewing machine having a thread cutting mechanism wherein a clutch for use in conjunction with thread cutting is dispensed with, thereby reducing the number of components of the sewing machine.

To achieve the above and other objects, according to one aspect of the present invention, there is provided a sewing machine which comprises a sewing motor; an arm spindle operatively coupled to the sewing motor and rotated about its own axis by the sewing motor; a needle bar; a needle attached to the needle bar; a needle bar disconnecting mechanism interposed between the arm spindle and the needle bar for normally transmitting rotations of the arm spindle to the needle bar to vertically move the needle bar up and down but disconnecting the needle bar from the arm spindle so that the rotations of the arm spindle are not transmitted to the needle bar when actuated; a thread cutting mechanism for cutting a needle thread and a bobbin thread when actuated; rotational phase detecting means for detecting a rotational phase of the arm spindle and producing a signal indicative of the detected rotational phase; and control means for actuating the needle bar disconnecting mechanism when the signal indicates a predetermined rotational phase after the thread cutting mechanism is actuated.

According to another aspect of the present invention, there is provided a sewing machine which comprises a sewing motor; an arm spindle operatively coupled to the sewing motor and rotated about its own axis by the sewing motor; a needle bar; a needle attached to the needle bar; a lateral feeding mechanism for feeding a workpiece fabric in a lateral direction when actuated; a needle bar disconnecting mechanism for normally vertically moving the needle bar up and down but stopping the vertical movement of the needle bar when the lateral feeding mechanism is being actuated; a thread cutting mechanism for cutting a needle thread and a bobbin thread when actuated; rotational phase detecting means for detecting a rotational phase of the arm spindle and producing a signal indicative of the detected rotational phase; and control means for actuating the needle bar disconnecting mechanism when the signal indicates a predetermined rotational phase after the thread cutting mechanism is actuated.

In operation, when the thread cutting mechanism is actuated, the needle bar disconnecting mechanism is sequentially actuated in response to the signal from the rotational phase detecting means indicating that the arm spindle has reached the predetermined rotational phase, whereupon the vertical movement of the needle bar is stopped. Therefore, a sewing needle does not stick into a workpiece fabric after cutting the threads. Further, when the lateral feeding mechanism is being actuated for stitching an embroidery in the workpiece fabric, the needle bar disconnecting mechanism is actuated to stop the vertical movement of the needle bar.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
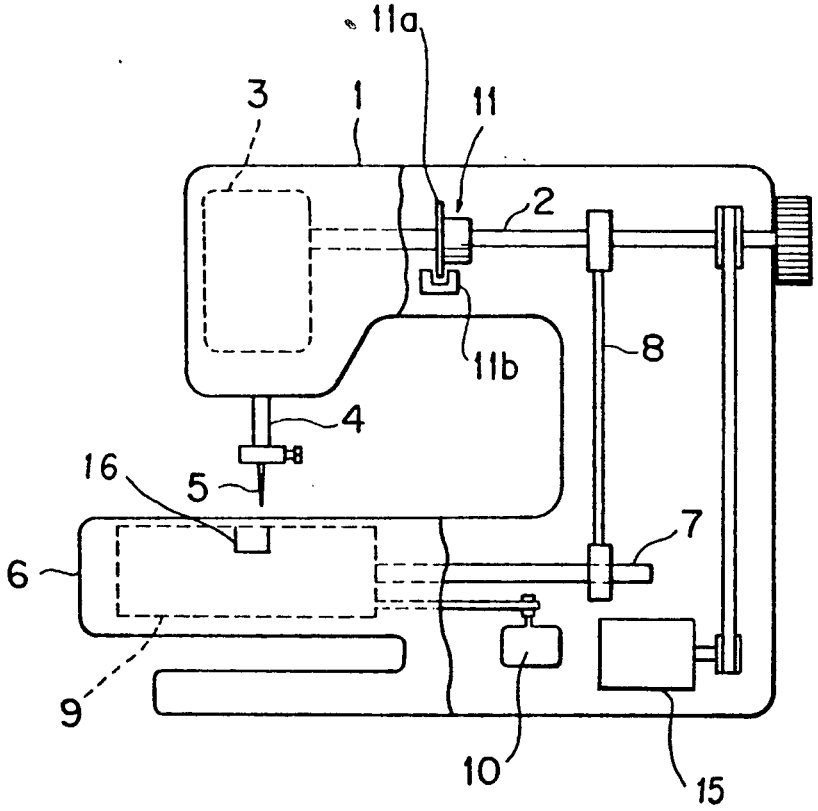
FIG. 1 is a vertical cross-sectional view showing a sewing machine according to the present invention.
Figure 2:
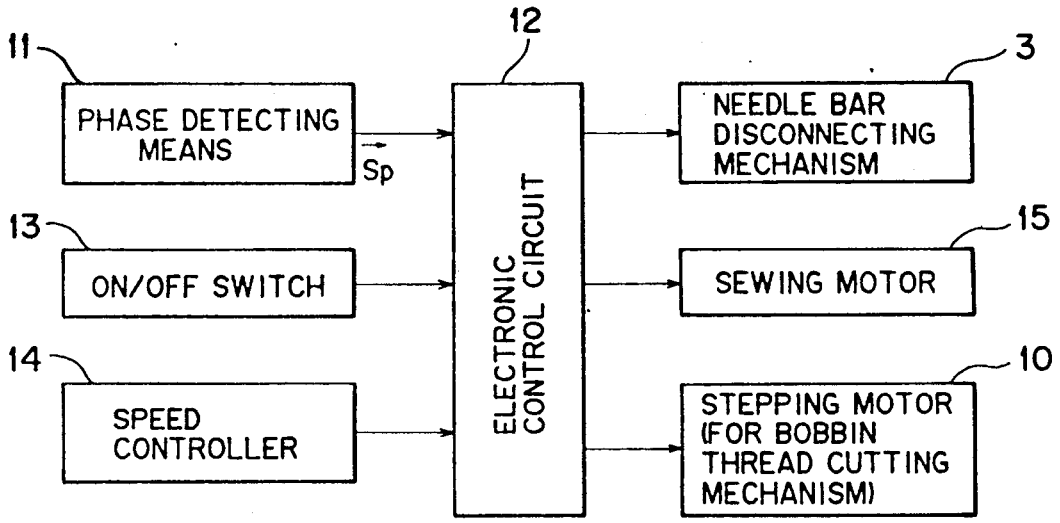
FIG. 2 is a block diagram for illustrating an electronic arrangement incorporated in the sewing machine shown in FIG. 1.

As shown in FIG. 1, an arm spindle 2 extending horizontally within an arm 1 has one end operatively coupled to a sewing motor 15 (also shown in FIG. 2) and another end coupled through a needle bar disconnecting mechanism 3 to a needle bar 4. A needle 5 is removably attached to the needle bar 4. Rotations of the arm spindle 2 are transmitted through the needle bar disconnecting mechanism 3 to the needle bar 4, thereby vertically moving the needle 5 up and down.

Various needle bar disconnecting mechanisms have been known in the art and thus detailed description thereof is omitted herein. Briefly, the needle bar disconnecting mechanism 3 includes a crank mechanism for converting an axial rotative motion of the arm spindle 2 to a vertical reciprocal motion to be imparted to the needle bar 4. When a solenoid is energized, a pawl provided in the crank side is disengaged from a needle bar gripper so that the power transmission to the needle bar 4 is interrupted. After deenergization of the solenoid, the pawl is brought into engagement with the needle bar gripper at a position where the needle bar gripper has reached the upper dead position, whereupon the power is transmitted to the needle bar gripper. The needle bar disconnecting mechanism employed in this embodiment is such that the needle bar gripper is urged upwardly at all times by a spring, wherein when the pawl is disengaged from the needle bar gripper, the needle bar is lifted to the upper dead position.

A bed spindle 7 extending horizontally within a bed 6 is operatively coupled through a transmission mechanism 8 to the arm spindle 2, whereby the axial rotative motion of the arm spindle 2 is transmitted to the bed spindle 7. The bed spindle 7 drives a lateral feeding mechanism 16 provided beneath a throat plate (not shown) and serves as a drive source for a thread cutting mechanism 9 provided also beneath the throat plate. The axial rotative motion of the bed spindle 7 is transmitted to the thread cutting mechanism 9 in accordance with energization of a stepping motor 10, whereupon the latter is actuated to cut threads in the portion beneath the throat plate when the arm spindle 2 is in a predetermined rotational phase (see FIG. 3).

In the arm 1, there is provided a phase detecting means 11 for detecting a rotational phase of the arm spindle 2. Specifically, the phase detecting mechanism 11 includes a light shielding plate 11*a* fixedly secured to the arm spindle 2 to be integrally rotatable therewith, and a photo-interrupter 11*b* disposed in an orientation so that the light shielding plate 11*a* traverses an optical path of the photo-interrupter 11*b*. The light shielding plate 11*a* is formed with a sector-shaped opening at a predetermined angular position. The rotational phase of the arm spindle 2 is detected by the interruption of the optical path of the photo-interrupter 11*b* by the light shielding plate 11*a*, and the phase detecting means 11 produces a phase detecting signal $S_p$ which is applied to an electronic control circuit 12 shown in FIG. 2. In response to the phase detecting signal $S_p$, the solenoid of the needle disconnecting mechanism 3 is controlled.

The electronic control circuit 12 includes a microcomputer and operates as a controller for the needle bar disconnecting mechanism 3. Further, the circuit 12 governs the overall operations of the sewing machine. For example, upon receipt of signals from an ON/OFF switch 13 and a speed controller 14, the circuit 12 controls the rotations of the sewing motor 15.

Figure 3:
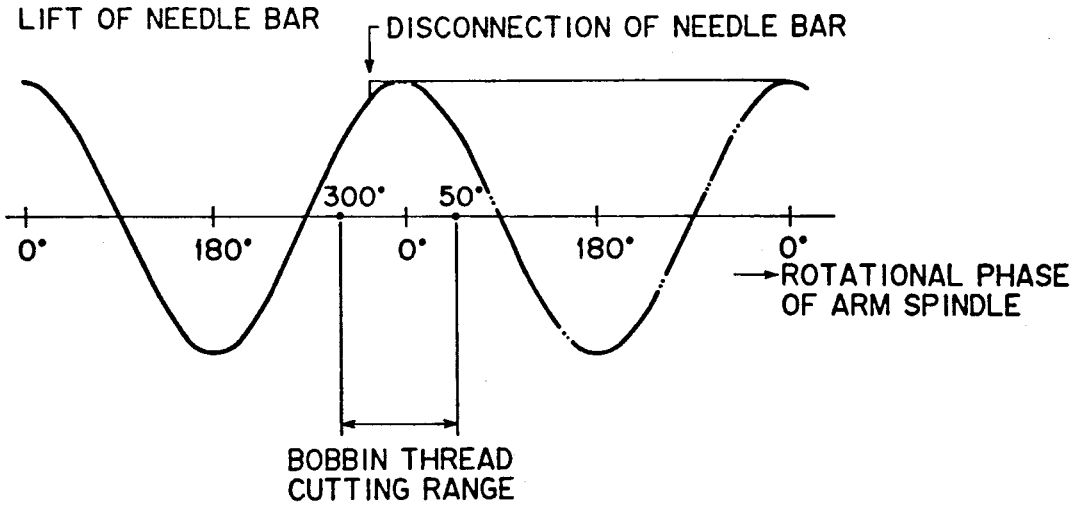
FIG. 3 is a graphical representation for illustrating a relation between movements of an arm spindle and a needle bar.

With the above-described arrangement, when a workpiece fabric is laterally fed to stitch an embroidery or a large decorative pattern, the needle bar disconnecting mechanism 3 is actuated, wherein the solenoid of the mechanism 3 is energized to disengage the pawl from the needle bar gripper. As a result, the needle bar 4 is disconnected from the arm spindle 2 and is stopped at the upper dead position as it is lifted by the spring. When the threads are to be cut at the termination of the stitching, the stepping motor 10 is first energized to transmit the rotations of the bed spindle 7 to the thread cutting mechanism 9, and then the threads are cut when the rotational phase of the arm spindle 2 is in a threads cutting range, e.g. when the rotational phase of the arm spindle 2 is in the range of between 300° to 50° as shown in FIG. 3.

On the other hand, the rotational phase of the arm spindle 2 has been monitored by the phase detecting means 11 at all times. When the stepping motor 10 has been energized for the threads cutting and further it has been detected that the rotational phase of the arm spindle 2 is brought to a predetermined value, say about 330° as shown in FIG. 3, the solenoid of the needle bar disconnecting mechanism 3 is energized in response to the signal fed from the electronic control circuit 12. Consequently, the pawl of the needle disconnecting mechanism 3 is disengaged from the needle bar gripper, causing to disconnect the needle bar 4 from the arm spindle 2, whereby the needle bar 4 is stopped at the upper dead position while being urged by the spring. Therefore, the needle 5 is prevented from being stuck in the workpiece fabric after cutting the threads. Thereafter, upon detection of the rotational phase of the arm shaft 2 out from the threads cutting range, the stepping motor 10 is again energized to thereby disconnect the thread cutting mechanism from the bed spindle 7. Further, when the rotational phase of the arm spindle 2 is brought to 0°, the pawl engages the needle bar gripper in the upper dead position so that the arm spindle 2 and the needle bar 3 are operatively coupled together.

As described, not only is the needle bar disconnecting mechanism 3 actuated while the workpiece fabric is being swung for stitching embroidery or the like, but also the same is actuated when the arm spindle 2 has reached the predetermined rotational phase after the actuation of the threads cutting mechanism 9. Therefore, a clutch mechanism which has heretofore been required for stopping the vertical movement of the needle bar after cutting the threads is no longer necessary. It is therefore advantageous in that the number of components required for fabricating the sewing machine can be reduced and hence the cost of the components and the manufacturing cost can be reduced.

What is claimed is:

1. A sewing machine comprising:

a sewing motor;

an arm spindle operatively coupled to said sewing motor and rotated about its own axis by said sewing motor;

a needle bar;

a needle attached to said needle bar;

a needle bar disconnecting mechanism interposed between said arm spindle and said needle bar for normally transmitting rotations of said arm spindle to said needle bar to vertically move said needle bar up and down but disconnecting said needle bar from said arm spindle so that the rotations of said arm spindle are not transmitted to said needle bar when actuated;

a thread cutting mechanism for cutting a needle thread and a bobbin thread when actuated;

rotational phase detecting means for detecting a rotational phase of said arm spindle and producing a signal indicative of the detected rotational phase; and control means for actuating said needle bar disconnecting mechanism when the signal indicates a predetermined rotational phase after said thread cutting mechanism is actuated.

2. A sewing machine according to claim 1, wherein said control means further acutates said thread cutting mechanism when the signal indicates that the rotational phase of said arm spindle is within a predetermined range.

3. A sewing machine according to claim 2, further comprising a stepping motor for causing said thread cutting mechanism to be in an operable condition when said stepping motor is driven, and wherein said needle bar disconnecting mechanism is actuated when the signal indicates that the rotational phase of said arm spindle has reached the predetermined rotational phase under a condition where said stepping motor has been driven.

4. A sewing machine according to claim 3, wherein said rotational phase detecting means comprises a light shielding plate secured to said arm spindle to be integrally rotatable therewith, and a photo-interrupter disposed in an orientation so that said light shielding plate traverses an optical path of said photo-interrupter.

5. A sewing machine comprising:

a sewing motor;

an arm spindle operatively coupled to said sewing motor and rotated about its own axis by said sewing motor;

a needle bar;

a needle attached to said needle bar;

a lateral feeding mechanism for feeding a workpiece fabric in a lateral direction when actuated;

a needle bar disconnecting mechanism interposed between said arm spindle and said needle bar for normally vertically moving said needle bar up and down but stopping the vertical movement of said needle bar when said lateral feeding mechanism is being actuated;

a thread cutting mechanism for cutting a needle thread and a bobbin thread when actuated;

rotational phase detecting means for detecting a rotational phase of said arm spindle and producing a signal indicative of the detected rotational phase; and control means for actuating said needle bar disconnecting mechanism when the signal indicates a predetermined rotational phase after said thread cutting mechanism is actuated.

6. A sewing machine according to claim 5, wherein said control means further actuates said thread cutting mechanism when the signal indicates that the rotational phase of said arm spindle is within a predetermined range.

7. A sewing machine according to claim 6, further comprising a stepping motor for causing said thread cutting mechanism to be an operable condition when said stepping motor is driven, and wherein said needle bar disconnecting mechanism is actuated when the signal indicates that the rotational phase of said arm spindle has reached the predetermined rotational phase under a condition where said stepping motor has been driven.

8. A sewing machine according to claim 7, wherein said rotational phase detecting means comprises a light shielding plate secured to said arm spindle to be integrally rotatable therewith, and a photo-interrupter disposed in an orientation so that said light shielding plate traverses an optical path of said photo-interrupter.

9. A sewing machine comprising:

a sewing motor;

an arm spindle operatively coupled to said sewing motor and rotated about its own axis by said sewing motor;

a needle bar;

a needle attached to said needle bar;

a needle bar disconnecting mechanism interposed between said arm spindle and said needle bar for normally transmitting rotations of said arm spindle to said needle bar to vertically move said needle bar up and down but disconnecting said needle bar from said arm spindle so that the rotations of said arm spindle are not transmitted to said needle bar when actuated;

a thread cutting mechanism for cutting a needle thread and a bobbin thread when actuated;

rotational phase detecting means for detecting a rotational phase of said arm spindle and producing a signal indicative of the detected rotational phase;

control means for actuating said needle bar disconnecting mechanism when the signal indicates a predetermined rotational phase after said thread cutting mechanism is actuated; and means for causing said thread cutting mechanism to be in an operable condition, wherein said needle bar disconnecting mechanism is actuated when the signal indicates that the rotational phase of said arm spindle has reached the predetermined rotational phase under a condition where said thread cutting mechanism is in the operable condition.

10. A sewing machine according to claim 9, wherein said control means further actuates said thread cutting mechanism when the signal indicates that the rotational phase of said arm spindle is within a predetermined range.

11. A sewing machine according to claim 9, wherein said rotational phase detecting means comprises a light shielding plate secured to said arm spindle to be integrally rotatable therewith, and a photo-interrupter disposed in an orientation so that said light shielding plate traverses an optical path of said photo-interrupter.

12. A sewing machine comprising:

a sewing motor;

an arm spindle operatively coupled to said sewing motor and rotated about its own axis by said sewing motor;

a needle bar;

a needle attached to said needle bar;

a lateral feeding mechanism for feeding workpiece fabric in a lateral direction when actuated;

a needle bar disconnecting mechanism interposed between said arm spindle and said needle bar for normally vertically moving said needle bar up and down but stopping the vertical movement of said needle bar when said lateral feeding mechanism is being actuated;

a thread cutting mechanism for cutting a needle thread and a bobbin thread when actuated;

rotational phase detecting means for detecting a rotational phase of said arm spindle and producing a signal indicative of the detected rotational phase;

control means for actuating said needle bar disconnecting mechanism when the signal indicates a predetermined rotational phase after said thread cutting mechanism is actuated; and means for causing said thread mechanism to be in an operable condition, wherein said needle bar disconnecting mechanism is actuated when the signal indicates that the rotational phase of said arm spindle has reached the predetermined rotational phase under a condition where said thread cutting mechanism is in the operable condition.

13. A sewing machine according to claim 12, wherein said control means further actuates said thread cutting mechanism when the signal indicates that the rotational phase of said arm spindle is within a predetermined range.

14. A sewing machine according to claim 13, wherein said rotational phase detecting means comprises a light shielding plate secured to said arm spindle to be integrally rotatable therewith, a photo-interrupter disposed in an orientation so that said light shielding plate traverses an optical path of said photo-interrupter.

* * * * *